United States Patent [19]

Smith

[11] 4,307,646

[45] Dec. 29, 1981

[54] STRINGED MUSICAL INSTRUMENT

[76] Inventor: Walter E. Smith, P.O. Box 707, Weiser, Id. 83672

[21] Appl. No.: 166,476

[22] Filed: Jul. 7, 1980

[51] Int. Cl.[3] ..... G10D 1/00

[52] U.S. Cl. ..... 84/173

[58] Field of Search ..... 84/173, 267, 291, 294

[56] References Cited

U.S. PATENT DOCUMENTS 2,023,358 12/1935 Porter ..... 84/173

4,024,788 5/1977 Dunlap ..... 84/267

*Primary Examiner*—George H. Miller, Jr.

*Assistant Examiner*—Benjamin R. Fuller

*Attorney, Agent, or Firm*—Lyon & Lyon

[57] ABSTRACT

A stringed musical instrument is similar in many respects to a guitar but it has no neck and therefore is shorter in overall length and lighter in weight. An inclined sound-transmitting plate is secured at spaced locations to a longitudinal strut. The plate is inclined in a plane parallel to the plane of the strings and it extends laterally to overlie a major portion of the upper wall of an acoustic sound-box. The plate and sound-box extend from the string anchors at one end of the strut to the tuning head at the other end.

8 Claims, 7 Drawing Figures

STRINGED MUSICAL INSTRUMENT

This invention relates to stringed musical instruments and is particularly directed to a short form of guitar which does not have the usual neck. The instrument is thus light in weight and compact in configuration and easier to transport.

A feature of this invention is the provision of a longitudinal sound-transmitting plate which extends substantially for the full length of the strings between the bridge and the nut. The plane of the strings and the plane of the sound-transmitting plate are parallel and both are inclined. This inclination enables the musician to hold the "steel" in a more comfortable position while sliding it along the strings, and it also enables a novel form of contact to be maintained between a laterally projecting edge of the inclined plate and the upper wall of an acoustic sound-box.

Such a device embodying this invention is economical to construct as compared to a conventional type guitar. The sound-generating assembly which includes a longitudinal strut, the inclined sound-transmitting plate, the strings, bridge, nut, and turning head, may be used with acoustic sound-boxes of almost any desired shape.

Other and more detailed objects and advantages will appear hereinafter.

Figure 1:
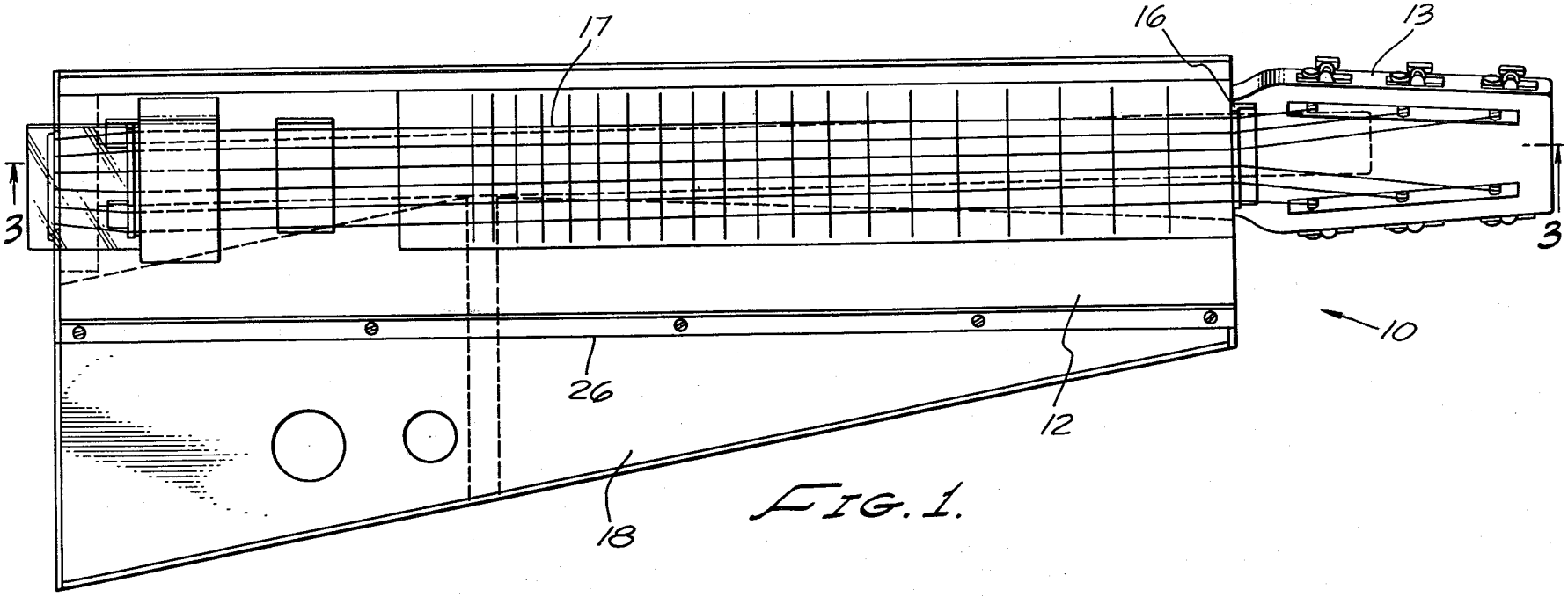
FIG. 1 is a plan view showing a preferred embodiment of this invention.
Figure 2:
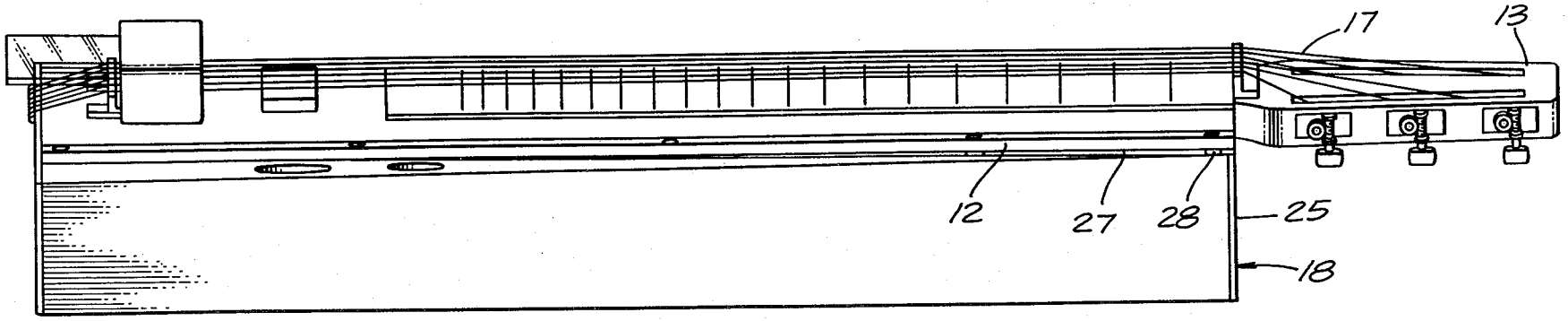
FIG. 2 is a side elevation thereof.
Figure 3:
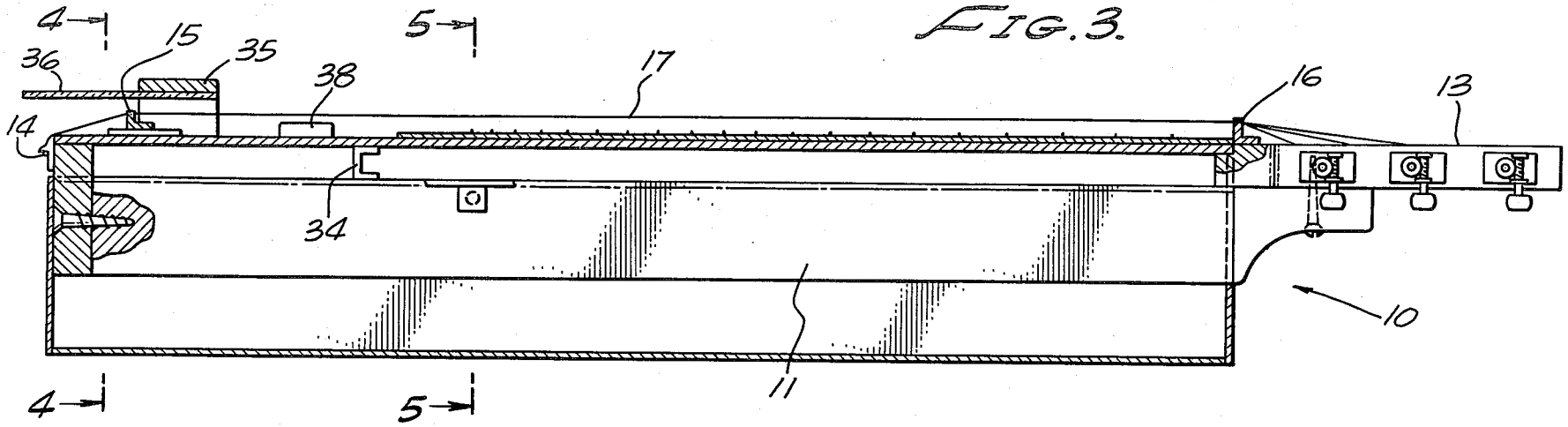
FIG. 3 is a sectional side elevation taken substantially on the lines 3—3 as shown on FIG. 1.

Referring to the drawings, the stringed musical instrument has a sound-generating assembly generally designated 10 and provided with a longitudinal strut 11 and a laterally extending inclined plate 12 secured thereto. A tuning head 13 is secured at one end of the strut 11 and string anchors 14 are provided at the other end. A string bridge 15 is mounted on the inclined plate 12 near the string anchors 14 and a string nut 16 is mounted on or near the turning head 13. The string bridge 15 and string nut 16 define a plane parallel to the upper surface of the inclined plate 12. Guitar strings 17 are tensioned over the bridge 15 and nut 16 between the tuning head 13 and the string anchors 14. The strings 17 are in the same inclined plane and are adapted to be contacted by the "steel" held manually and moved in sliding contact with the strings in the manner of a Hawaiian type guitar.

As best shown in FIGS. 1–4, an acoustic sound-box 18 is formed by the upper wall 19, lower wall 21, front and rear walls 22 and 23, and the end walls 24 and 25. The inclined plate 12 also serves as one wall of the acoustic sound-box 18. The lateral dimension of the sound-box 18 is greater near the bridge 15 than near the nut 16.

Sound vibrations of the tensioned strings 17 are transmitted through the bridge 15 to the inclined plate 12 and then through its lower edge 26 to the upper wall 19 of the acoustic sound-box 18. The lower edge 26 of the inclined plate 12 does not contact the upper wall 19 throughout its length; on the contrary, a wedge-shaped clearance space 27 is produced by an insulating spacer 28 near the end wall 25. A transverse support rib 29 is fixed to the strut 11 and extends laterally to support the upper wall 19 of the sound-box 18. Metal reinforcing strips 31 and 32 may be positioned on parallel longitudinal edges 26 and 33 of the inclined plate 12. These reinforcing strips 31 and 32 are functional as well as decorative because they help prevent buckling of the inclined plate 12 under compression forces exerted by the tensioned strings 17. A cross brace 34 is preferably provided between the strut 11 and the inclined plate 12.

It will be observed that the acoustic sound-box 18 extends to the tuning head 13; there is no part similar to the neck found on Spanish type guitars or Hawaiian type guitars. A conventional electrical pickup may be provided at 38 on the inclined plate 12.

Figure 5:
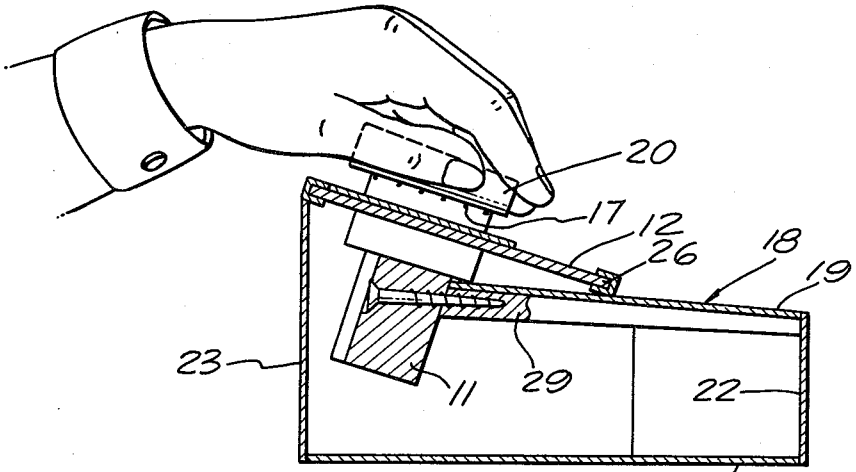
FIG. 5 is a transverse sectional elevation taken substantially on the lines 5—5 as shown on FIG. 3, a musician's left hand being shown in position holding the slide bar or "steel".
Figure 4:
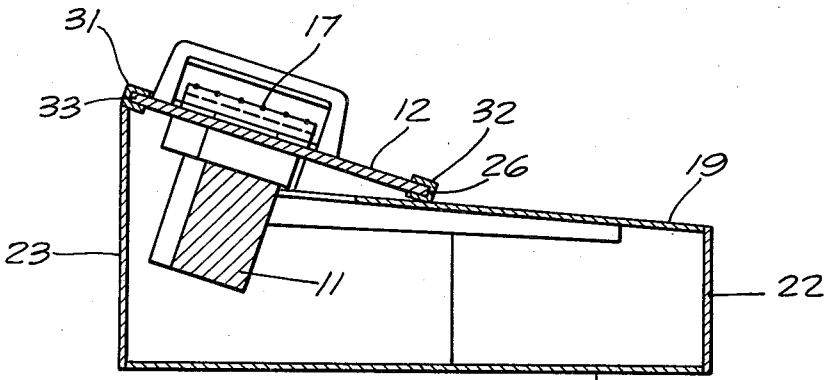
FIG. 4 is a transverse sectional elevation taken substantially on the lines 4—4 as shown on FIG. 3.

A bracket 35 may be provided to straddle the strings 17 and to carry a hand rest 36. The hand of the musician that holds the guitar "pick" for sounding the strings 17 may be supported on this hand rest 36. As shown in FIG. 5, the inclination of the plate 12 and plane of the strings 17 makes it easier for the musician to hold the slide bar 20 in his other hand and manipulate it along the guitar strings 17.

Figure 6:
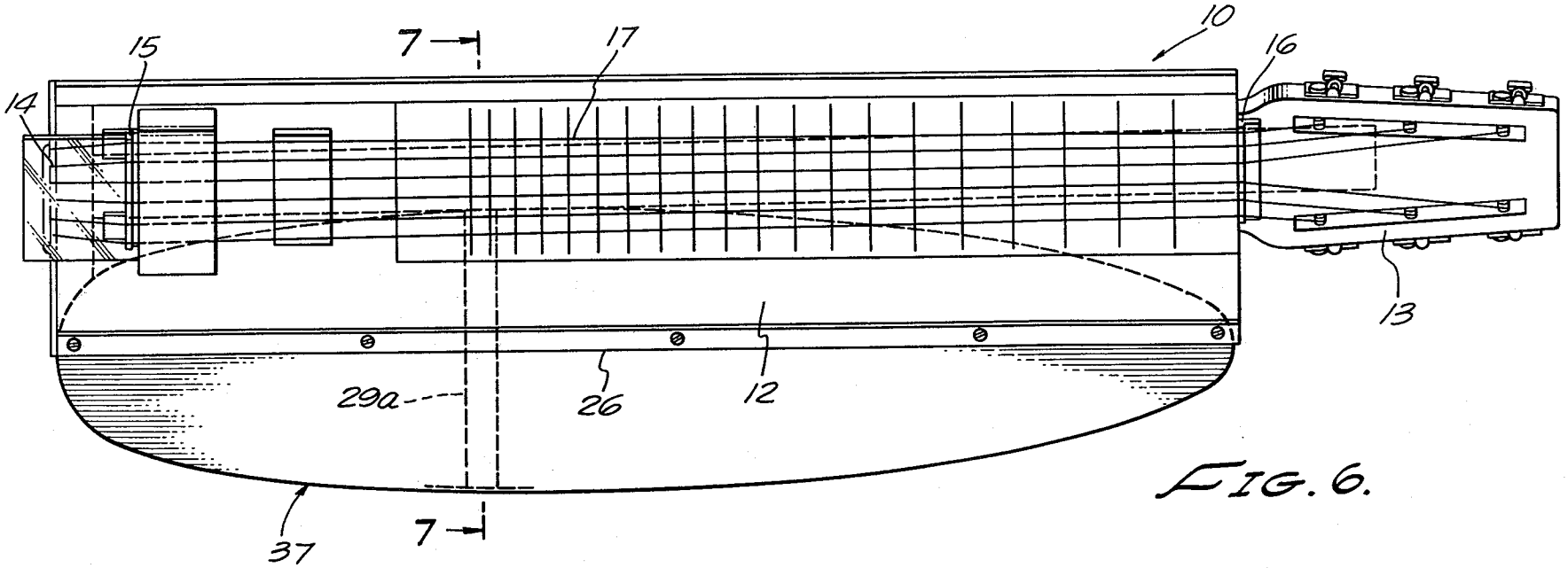
FIG. 6 is a plan view showing a modification.
Figure 7:
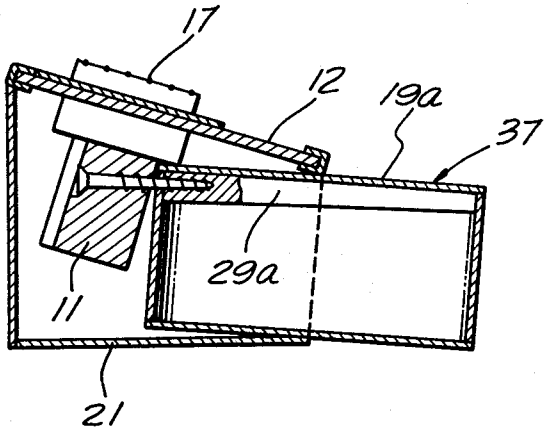
FIG. 7 is a transverse sectional view taken substantially on the lines 7—7 as shown on FIG. 6.

In the modified form of the invention shown in FIGS. 6 and 7, the sound-generating assembly 10, that is, the strut 11, inclined plate 12, tuning head 13, string anchors 14, bridge 15, nut 16, and strings 17, are substantially the same as that previously described. However, the acoustic sound-box 18 is supplemented by the additional oval sound-box 37 which extends into the sound-box 18 between the edge 26 of the inclined plate 12 and the bottom wall 21. The transverse support rib **29*a* fixed to the upper wall 19*a* of the oval sound-box 37 is fixed with respect to the strut 11. The contact between the edge 26 of the inclined plate 12 and the upper surface of the wall 19*a*** is the same as that previously described.

Having fully described my invention, it is to be understood that I am not to be limited to the details herein set forth but that my invention is of the full scope of the appended claims.

I claim:

1. In a musical stringed instrument of the like, the combination of: a longitudinal strut having a tuning head near one end and string anchors near the other end, a longitudinal sound-transmitting plate secured at spaced locations to said strut, a string bridge mounted on said sound-transmitting plate near one end thereof and a string nut mounted near the other end, said bridge and nut defining a plane for strings, said sound-transmitting plate being laterally inclined, means including a sound-box forming an acoustic chamber extending to said tuning head, said sound-box having an upper wall secured to said strut, said sound-transmitting plate projecting laterally to overlie a substantial portion of the upper wall of said sound-box, and said plate having a projecting edge contacting said upper wall.

2. The combination set forth in claim 1 in which the upper wall of said sound-box contacts said strut at longitudinally spaced locations.

3. The combination set forth in claim 1 in which only a portion of the length of the projecting edge of said sound-transmitting plate contacts the upper wall of said hollow sound-box, and a remaining portion has clearance with respect thereto.

4. The combination set forth in claim 1 in which said projecting edge extends longitudinally, sound sound-transmitting plate having another longitudinal edge, and longitudinal reinforceing elements provided on each of said edges.

5. The combination set forth in claim 1 in which the lateral dimension of the sound-box is greater near said string bridge than near said string nut.

6. The combination set forth in claim 1 in which the sound-box is substantially oval in shape and contains an acoustic chamber.

7. A sound-generating assembly for a musical instrument having an acoustic sound-box provided with an upper wall, comprising in combination: a longitudinal strut, a tuning head fixed to one end of said strut, string anchors supported near the other end of said strut, a longitudinal sound-transmitting plate secured at spaced locations to said strut, a string bridge mounted on said sound-transmitting plate near one end thereof and a string nut mounted near the other end, said bridge and nut defining a plane for strings, said sound-transmitting plate projecting laterally to overlie a substantial portion of the upper wall of the sound-box, said plate extending to said nut and having a projecting edge for contact with said upper wall, and means for attaching the sound-box with respect to said strut.

8. A sound-generating assembly for a musical instrument having a portion provided with an upper surface, comprising in combination: a longitudinal strut, a tuning head fixed to one end of said strut, a longitudinal sound-transmitting plate secured at spaced locations to said strut, a string bridge mounted on said sound-transmitting plate near one end thereof and a string nut mounted near the other end, said bridge and nut defining an inclined plane for strings, said sound-transmitting plate being laterally inclined and projecting laterally to overlie a substantial portion of said upper surface, said plate extending to said nut and having a projecting edge for contact with said upper surface.

* * * * *